United States Patent [19]

Jackisch

[11] 4,176,072

[45] Nov. 27, 1979

[54] DIESEL ENGINE CRANKCASE LUBRICATING OIL COMPOSITION

[75] Inventor: Philip F. Jackisch, Royal Oak, Mich.

[73] Assignee: Ethyl Corporation, Richmond, Va.

[21] Appl. No.: 889,015

[22] Filed: Mar. 22, 1978

[51] Int. Cl.[2] ..... C10M 1/48

[52] U.S. Cl. ..... 252/32.7 E; 252/46.6; 252/48.6

[58] Field of Search ..... 252/32.7 E, 48.6, 46.6

[56] References Cited

U.S. PATENT DOCUMENTS

| | | | |
|---|---|---|---|
| 2,680,718 | 6/1954 | Eby | 252/48.6 |
| 2,921,027 | 1/1960 | Brennan | 252/32.7 E |
| 3,347,790 | 10/1967 | Meinhardt | 252/32.7 E X |
| 3,652,410 | 3/1972 | Hollinghurst et al. | 252/32.7 E |

*Primary Examiner*—Delbert E. Gantz
*Assistant Examiner*—Andrew Metz
*Attorney, Agent, or Firm*—Donald L. Johnson; Robert A. Linn; Joseph D. Odenweller

[57] ABSTRACT

Lubricating oil adapted for use in diesel engines containing a sulfurized fatty acid ester of a polyhydric alkanol, e.g. sorbitan mono-ester of sulfurized oleic acid.

5 Claims, No Drawings

DIESEL ENGINE CRANKCASE LUBRICATING OIL COMPOSITION

BACKGROUND OF THE INVENTION

Esters of polyhydric alkanols have been used in mineral oil blends. Their principle function appears to have been as rust and corrosion inhibitors. Typical background patents showing such use are U.S. Pat. Nos. 2,138,771, 2,398,193, 2,434,978, 2,470,537, 2,474,604, 2,482,517, 2,560,202, 2,580,036 and 2,587,545.

Diesel engines are well known for their long endurance under most severe conditions. Because of this they have found favor for use in heavy duty trucks and locomotives. Although engines have seen limited use in light duty automotive application, it is only recently that such use has begun to increase sharply. This is due to industry attempts to achieve increased fuel economy. In general, these light duty automotive diesel engines are not as heavily constructed as prior heavy duty engines and less expensive metals and metal alloys are used. This has brought about a wear problem in light duty automotive diesel engines that was not of such significance in heavy duty engines.

The wear problem appears to be due mainly to blow-by carbon soot which accumulates in the crankcase. This soot either causes wear or serves to negate the effect of additives such as zinc dihydrocarbyldithiophosphates which are customarily added to inhibit wear. In fact, in tests it has been found that zinc dihydrocarbyldithiophosphates, rather than acting as a wear inhibitor, can, in the presence of carbon soot, cause an increase in wear.

SUMMARY OF THE INVENTION

It has now been found that certain sulfurized fatty acid esters of polyhydric alkanols can significantly improve the wear characteristics of lubricaring oil used as a diesel crankcase lubricant.

DESCRIPTION OF THE PREFERRED EMBODIMENTS

A preferred embodiment of the invention is a lubricating oil composition especially adapted for use in diesel cycle internal combustion engines, said composition comprising a major amount of lubricating oil and a minor amount of a sulfurized fatty acid ester of an anhydrohexitol, said minor amount being an amount which is effective in reducing engine wear caused in part by blow-by carbon soot.

Polyhydric alkanols containing 6 carbon atoms and 6 hydroxyl groups can be used to make the esters. They are referred to herein as hexitols and are exemplified by sorbitol, mannitol, dulictol, iditol and talitol. Of these, the most preferred are sorbitol and mannitol.

The most preferred polyhydric alkanols are the anhydrohexitols. These are hexitols from which one molecule of water has been intramolecularly removed to form an internal anhydride in the form of a cyclic ether. These are exemplified by sorbitan, mannitan, dulcitan, iditan and talitan. Of these, sorbitan and mannitan are more preferred. Sorbitan is the most preferred polyhydric alkanol.

Useful sulfurized fatty acids include those which when esterified with one of the described polyhydric alkanols form an oil soluble ester. Preferably the sulfurized fatty acid contains from about 6 to 22 carbon atoms. These are exemplified by sulfurized caproic acid, enanthylic acid, caprylic acid, pelargonic acid, capric acid, undecyclic acid, ricinoleic acid, myristic acid, palmitic acid, stearic acid, arachidic acid, behenic acid, linoleic acid, dimers and trimers of linoleic acid and the like.

Sulfurized unsaturated fatty acids, especially those containing monoolefinic unsaturation, are very useful in forming the esters. These include sulfurized hexenic acids, hypogeic acid, oleic acid, elaidic acid, erucic acid, brassidic acid and the like.

The fatty acid can be sulfurized by well-known methods. For example, one can add sulfur to the fatty acid and heat the mixture to a temperature of about 50°-300° C., more preferably about 200°-250° C. A closed system can be used to prevent loss. Excess sulfur is generally used and unreacted sulfur is then removed by filtration.

The most useful fatty acid is sulfurized oleic acid. The most preferred ester is sulfurized oleic acid monoester of sorbitan.

The esters are made by conventional methods such as by heating a mixture of the alkanol and acid while distilling off water as formed. Conventional esterification catalysts such as p-toluene sulfonic acid can be used. Likewise, distillation aids such as toluene can be included to help in the removal of water. The mole ratio of acid to hexitol can vary widely. A useful range is from about 1 to 6 moles of acid per mole of hexitol. More preferably, about 1-3 moles of acid per mole of hexitol is used. For example, to make sulfurized sorbitan monooleate one would use about one mole of sulfurized oleic acid per mole of sorbitan and heat to remove water generally in the presence of a distillation aid (e.g. xylene) and a catalyst (e.g. $H_2SO_4$).

Another method of preparing the sulfurized ester is to first prepare the ester of the polyol using unsulfurized fatty acid and then to sulfurize the resultant ester by mixing the ester with sulfur and heating the mixture to a temperature high enough to cause sulfur to react, but not so high as to cause the product to decompose. Sulfurization temperatures of about 50°-300° C. usually suffice. For example, sorbitan monooleate can be made by heating a mixture of oleic acid and sorbitol or sorbitan in the presence of xylene and p-toluene sulfonic acid. The resultant ester is isolated and then sulfurized by adding about 5 wt % sulfur powder and heating the mixture to 200°-250° C.

It is not necessary to completely esterify all of the hydroxyl groups on the polyol although this can be done. Following are examples of sulfurized esters having various degrees of esterification:

sulfurized sorbitan monohexenate
sulfurized mannitantrioleate
sulfurized sorbitol dielaidiate
sulfurized doculitan monoerucate
sulfurized iditan dilinoleate
sulfurized mannitol tribrassidate
sulfurized sorbitan dioleate The following example illustrates one method of making the additives.

EXAMPLE

In a reaction vessel was placed 93.7 gms of commercial sulfurized oleic acid (9.5% S), 58 gms sorbitol and 1 gm conc. $H_2SO_4$. The mixture was stirred and heated to 160° C. The sorbitol melted at about 100° C. and at 160° C. water was evolved. Xylene was added to assist in codistillation of the water using a Dean Stark water trap. Refluxing was continued for 2.5 hours. About 2 gms of $MgCO_3$ was added and the mixture was filtered and the filtrate stripped of volatiles using a rotary evaporator. The resultant sulfurized sorbitan monooleate contained 7.0% sulfur.

The zinc dihydrocarbyldithiophosphate (ZDDP) used in the oil compositions are of the conventional type used in engine lubricant formulations. These include both the alkyl type exemplified by those containing isobutyl- and isopentylalkyl groups and the aryl type exemplified by those containing alkaryl groups such as nonylphenyl groups. Likewise, mixed alkyl-aryl type ZDDP can be used. The hydrocarbyl groups contain about 3–20 carbon atoms and are of sufficient size to insure oil solubility.

These ZDDP additives are conventionally made by reacting phosphorus pentasulfide with the desired alkanol (e.g. isobutanol, pentanol, 2-ethylbutanol and the like) or phenol (e.g. p-nonylphenol) to form O,O-dihydrocarbyldithiophosphoric acid and then neutralizing this acid with zinc oxide.

Alkanols are used to make alkyl-type dithiophosphate and alkylphenols are used to make aryl-type dithiophosphates. Mixed types can also be used such as mixed alkyl-aryl dithiophosphates.

The amount of ZDDP used in the lubricating oil formulations should be enough to provide the desired antioxidant protection. This concentration is conventionally expressed in terms of weight percent zinc in the lubricarting oil. A useful range is 0.005–0.5 wt % zinc. A preferred range is 0.01–0.25 wt % zinc.

The amount of sulfurized fatty acid ester used should be an amount which will substantially reduce engine wear in the presence of blow-by soot such as is encountered in diesel engines. A useful ester range is about 0.25–3 wt % based on the formulated oil.

The oil used is preferably a mineral oil or a blend of mineral oil with a synthetic hydrocarbon oil such as α-olefin oligomer (e.g. α-decene trimer) or an alkylbenzene (didodecylbenzene). Other synthetic oils such as the synthetic ester oils (e.g. dinonyladipate or trimethylpropane tripelargonate) can be used.

Other additives may be used in formulating the oil such as barium or calcium alkylphenates, sulfurized calcium phenates, phosphorosulfurized polyolefin, barium salts of phosphorosulfurized polyisobutylene, calcium petroleum, sulfonates, dispersants such as the polyisobutylene succinimide of tetraethylenepentamine, Mannich condensation products of polyisobutylphenol-formaldehyde-tetraethylene-pentamine and similar boronated Mannichs, phenolic antioxidants such as 4,4'-methylenebis(2,6-di-tert-butylphenol), polymethacrylate and ethylene propylene copolymer VI improvers and the like.

The lubricating oil compositions are most useful in the crankcase of diesel engines. Diesel engines introduce carbon soot into the crankcase through piston blow-by. Tests have shown that in the presence of carbon soot ZDDP can act to increase wear rather than to reduce wear. The tests carried out were standard 4-ball wear tests in which one steel ball was rotated under load against 3 fixed balls in a pyramid arrangement. The balls were immersed in a mineral lubricating oil at 93° C. containing the test additives. Applied load was 15 kg and rotation was at 1800 rpm for 30 minutes. Wear was determined by measuring the diameter of the scar on the fixed balls. A larger scar diameter means more wear.

The oil used in the tests was a mineral oil (2.5 cs 99° C.) containing 2 wt % of a commercial succinimide dispersant and 2 wt % lampblack. Tests were conducted both with and without a commercial ZDDP (concentration to provide 0.15 wt % Zn). Results were as follows:

| Test Additive | Conc (wt %) | Scar Diameter (mm) Without ZDDP | With ZDDP |
|---|---|---|---|
| None (1) | — | — | 0.27 |
| None (2) | — | 0.43 | 0.64 |
| Sulfurized sorbitan monooleate | 1% | 0.67 | 0.33 |

(1) No test additive and no lampblack.
(2) No test additive, but does include lampblack.

The test oil without lampblack, dispersant or any additive gave a scar diameter of 0.58 mm. ZDDP without lampblack reduced the wear index to only 0.27 mm. However, when lampblack was added the wear index with ZDDP increased sharply to 0.64 mm, which is higher than even the base oil without ZDDP (0.58 mm). When sulfurized sorbitan monooleate was used in combination with ZDDP the wear index dropped significantly down to 0.33 mm.

I claim:

1. A lubricating oil composition especially adapted for use in the crankcase of diesel engines in the presence of blow-by carbon soot, said composition comprising a major amount of lubricating oil and the combination of an oil soluble zinc dihydrocarbyldithiophosphate and about 0.25–3.0 weight percent of a sulfurized fatty acid ester of an anhydrohexitol, said zinc dihydrocarbyldithiophosphate in the absence of said sulfurized fatty acid ester tending to increase engine wear due to soot and said zinc dihydrocarbyldithiophosphate is present in an amount sufficient to provide from 0.005 to 0.5 weight percent zinc to the composition 2. A lubricating oil composition of claim 1 wherein said anhydrohexitol is sorbitan.

3. A lubricating oil composition of claim 2 wherein said sulfurized fatty acid is sulfurized oleic acid.

4. A lubricaring oil composition of claim 3 wherein said zinc dihydrocarbyldithiophosphate is an oil soluble zinc dialkyldithiophosphate.

5. A lubricating oil composition of claim 3 wherein said zinc dihydrocarbyldithiophosphate is an oil soluble aryl-type dithiophosphate.

* * * * *